US009610614B2

(12) United States Patent
Woodgate et al.

(10) Patent No.: US 9,610,614 B2
(45) Date of Patent: Apr. 4, 2017

(54) SCREENING PANEL AND METHOD OF FIXING

(71) Applicant: Lettela Pty Limited, Airport West (AU)

(72) Inventors: Raymond Maxwell Woodgate, Bacchus Marsh (AU); Marc Raymond Woodgate, Bacchus Marsh (AU)

(73) Assignee: Lettela Pty Limited, Airport West (AU)

( * ) Notice: Subject to any disclaimer, the term of this patent is extended or adjusted under 35 U.S.C. 154(b) by 0 days.

(21) Appl. No.: 14/680,238

(22) Filed: Apr. 7, 2015

(65) Prior Publication Data

US 2015/0283583 A1 Oct. 8, 2015

(30) Foreign Application Priority Data

Apr. 8, 2014 (AU) ..... 2014901280

(51) Int. Cl.
*B07B 1/49* (2006.01)
*B07B 1/46* (2006.01)

(52) U.S. Cl.
CPC ..... *B07B 1/4609* (2013.01); *B07B 1/4645* (2013.01); *B07B 1/46* (2013.01); *B07B 2201/02* (2013.01)

(58) Field of Classification Search
CPC ..... B07B 1/46; B07B 1/4609; B07B 1/4645; B07B 2201/02

(Continued)

(56) References Cited

U.S. PATENT DOCUMENTS 4,674,251 A 6/1987 Wolff
6,260,711 B1 * 7/2001 Woodgate ..... B07B 1/4645 209/399

(Continued)

FOREIGN PATENT DOCUMENTS

AU 577767 B2 9/1988
AU 2012201297 A1 9/2012
AU 2012211453 A1 2/2013

*Primary Examiner* — Joseph C Rodriguez
*Assistant Examiner* — Kalyanavenkateshware Kumar
(74) *Attorney, Agent, or Firm* — Walter | Haverfield LLP; D. Peter Hochberg; Sean F. Mellino

(57) ABSTRACT

A screen panel 15 for mounting to a vibratory screening apparatus that includes a plurality of beams 11 to which screen panels 15 can be mounted. The screen panel 15 comprises a square or rectangular frame 21 including a pair of spaced apart and parallel side frame members 25 and a pair of spaced apart and parallel end frame members 38 connected to the side frame members 25. The frame 21 defines an upper edge and the side and end frame members define a square or rectangular outwardly facing surface. The frame 21 is connectable to a pair of adjacent beams 11 by connectors 20 that connect with the outwardly facing surface of the side frame members 25. The screen panel 15 also comprises a square or rectangular screen 22 connected to the frame 21 which extends over the upper edge of the frame 21 and forms a square or rectangular skirt 33, 36. The skirt 33, 36 overlies the outwardly facing surface of the frame 21 and connects to each of the side and end frame members along the outwardly facing surface to connect the screen 22 to the frame 21. The connection between skirt 36 and the outwardly facing surface of the side frame members 25 is made closer to the upper edge of the frame than where the connection between the connectors 20 and the outwardly facing surface of the side members 25 of the frame 21 is made.

16 Claims, 6 Drawing Sheets

(58) Field of Classification Search
USPC ..... 209/363, 395, 399, 403, 405, 408
See application file for complete search history.

(56) References Cited

U.S. PATENT DOCUMENTS

| | | | | |
|---|---|---|---|---|
| 6,267,246 | B1 * | 7/2001 | Russell | B07B 1/4618 209/399 |
| 8,286,799 | B2 * | 10/2012 | Malmberg | B07B 1/46 209/391 |
| 2005/0236305 | A1 * | 10/2005 | Schulte | B01D 29/012 209/403 |
| 2007/0175802 | A1 * | 8/2007 | Johnson | B07B 1/4645 209/397 |
| 2013/0037459 | A1 * | 2/2013 | Woodgate | B07B 1/46 209/405 |

* cited by examiner

SCREENING PANEL AND METHOD OF FIXING

TECHNICAL FIELD

The present invention relates generally to apparatus for screening, separating or grading materials, principally for use in the mining industry. The present invention is particularly directed to a system for fixing screen panels to the support frame of a vibratory screening apparatus and it will be convenient to hereinafter describe the invention in relation to that use.

BACKGROUND OF INVENTION

A reference herein to a patent document or other matter which is given as prior art is not to be taken as an admission that that document or matter was known or that the information it contains was part of the common general knowledge as at the priority date of any of the claims.

Screening apparatus of the type with which the invention is concerned is generally used for screening, grading, or separating materials such as mining ores and comprises an array of screen panels which are removably fixed to a frame to provide a continuous screen deck. The material to be screened is fed onto the deck at one end and the apparatus is vibrated so that the material moves over and through its screening surface.

One form of screen panel includes a steel frame moulded within a resilient plastic material, such as polyurethane. See for an example of such a screen panel, Australian Patent No. 577767 (66006/86). The plastic moulding forms the major part of the panel and it is in the plastic moulding that the openings for screening are provided. The steel frame provides rigidity to the screen panel.

Other forms of screen panels include an assembly which comprises a hard plastic frame and a separate rubber or polyurethane screen surface that is releasably attached to the frame. In this arrangement, the plastic frame can be attached to the subframe of a vibratory screening machine first and the rubber or polyurethane screen surface can then be attached to the plastic frame. Alternatively, the polyurethane screen surface can be attached to the plastic frame first and the assembly can then be attached to the subframe of the vibratory machine. The advantage of a panel assembly of this kind is that the assembly is generally more flexible and is generally less expensive than the encapsulated steel frame version discussed above, because the screen surface can be replaced without necessarily also replacing the frame. The assembly also provides flexibility in the combination of frame and screen surface, given that various different grades of screen surfaces, ie harder or softer, or with larger or smaller screening apertures, can be attached to the one form of frame. These forms of assembly can include a polyurethane or rubber coated steel or plastic frame in which the screen surface is formed by the polyurethane or rubber coating.

In the panel assembly described above, care must be taken in the design of the frame and screen surface, in particular in relation to the connection between them, given that in use, with the panel assembly applied to the deck of vibratory machinery, the panel assembly will be subject to significant vibration and the screen surface can disconnect or release from the frame if the connection between them is not sufficiently secure.

In all forms of screening apparatus, the material being screened (ores for example) causes the screen panels to wear over time, due to the abrasiveness of the ores or materials typically being screened, and thus the screen panels require periodic replacement. Replacement causes downtime of the vibratory machinery and loss of output of the mine. Accordingly, the ease and speed of replacement of the worn parts (either just the screen surface, or the screen surface and the frame to which the screen surface is attached) is of significant importance to the mine operator. It follows therefore that screen panels should be relatively easy to fit to and remove from the subframe of a vibratory machine.

As indicated above, in some installations, the operators of the vibratory machinery will remove only the screen surface of the panel assembly when sufficient wear of the screen surface has taken place, rather than removing both the frame and the screen surface for replacement. Thus, the panel assembly is configured so that removal of the screen surface only, rather than removal of the screen surface and the frame, is possible. This reduces the cost for the mine operator because the frame is not replaced, but the saving is only useful if a new screen surface can be fitted to the existing frame that remains connected to the vibratory machinery quickly and easily, so that time lost in downtime of the vibratory machinery is not more than would have been experienced with replacement of the complete panel assembly (comprising the screen surface and the frame).

Systems have been developed in the past for fixing screen panels to the subframe of a vibratory machine, whereby individual panels can be removed and replaced when worn. In applicant's Australian Patent No. 2012201297, a system has been developed in which panels can be fixed to vibratory machinery along a pair of opposite edges. The arrangement disclosed allows for a small amount of adjustment movement of the panels as they are applied to a deck to ensure close fitting and alignment between adjacent panels. In the arrangement of Patent No. 2012201297, the panels are securely fixed to the subframe of the vibratory machine by engagement along a major portion of the opposite sides of the respective panels with elongate fixing members that connect to the subframe itself. The extent of engagement between the panels and the elongate fixing members provides for very secure connection between the panels and the subframe.

The present invention has been developed with the above form of screening apparatus of applicant's Patent No. 2012201297 in mind, although it should be appreciated that the invention could have wider use with other forms of screening apparatus and screen panels.

SUMMARY OF INVENTION

The present invention provides a screen panel for mounting to a vibratory screening apparatus for the purpose of screening, separating or grading materials, the screening apparatus including a plurality of spaced apart, substantially parallel elongate beams to which the screen panel is to be mounted, the screen panel comprising:

i. a square or rectangular frame which includes a pair of spaced apart and parallel side frame members and a pair of spaced apart and parallel end frame members connected to the side members, the frame defining a square or rectangular upper edge and the side and end frame members defining a square or rectangular outwardly facing surface, the frame being connectable to a pair of adjacent elongate beams of a vibratory screening apparatus by connectors that connect with the outwardly facing surface of the side frame members, ii. a square or rectangular screen which is connected to the frame, the screen extending over the upper edge of the frame and forming a square or rectangular skirt which overlies the outwardly facing surface of the frame and which connects to each of the side and end frame members along the outwardly facing surface to connect the screen to the frame, iii. the connection between skirt of the screen and the outwardly facing surface of the side frame members of the frame being made closer to the upper edge of the frame than where the connection between the connectors and the outwardly facing surface of the side members of the frame is made.

A screen panel according to the present invention advantageously provides for a secure and robust connection between the screen and the frame and between the screen panel and the subframe of a vibratory machine. Between the screen and the frame, the connection provided in the invention is made with the outwardly facing surface of each of the sides and the ends of the frame. This differs from some prior art where the connection is with the sides of the frame only and not the ends.

A problem with some prior art screen panels is that over time, material being screened can become stuck within openings of the screen surface to block those openings and if sufficient openings become blocked, the screen surface becomes clogged and is no longer capable of proper screening. In that case, the vibratory machinery must be shut down to clear the openings of the screen surface. Blockage of openings is reduced or less likely where the screen surface can oscillate between the sides and ends of the frame during a screening operation. Such oscillation can clear the openings of blockage while the vibratory machinery is operating and thus remove the need for shutdown. Prior art screen panels in which the frame is encapsulated with the screen often provide only a small amount of potential oscillation, because the frame normally has a central stiffening member that is encapsulated and so the free distance for oscillation is from the central member to the side and end members. However, in the present invention the screen is separate from the frame, ie the frame is not encapsulated within the screen, and even where a central stiffening member is provided, the screen surface can still oscillate relative to that member, so that the free distance for oscillation is fully across the screen surface between the side and end members. This allows for increased oscillation and thus improved clearance of blocked openings. This is particularly advantageous in relation to high moisture ore clay type ores.

The connection between the screen panel (the combined screen and frame) and the subframe of a vibratory machine is also improved by the present invention over some of the prior art because the connection is made between the frame of the screen panel and the subframe. This is different to many prior art arrangements in which the screen forms part of the connection with the subframe. This means that the screen must have structural characteristics suitable for connection to the subframe that might not be appropriate or desirable for the material being screened. For example, the hardness of the screen needed for structural rigidity might not correspond either to the optimum flexibility of the screen for oscillation as described above, or for minimising wear of the screen surface. In contrast, in a screen panel of the present invention, the characteristics of the screen can be chosen for screening purposes, while the characteristics of the frame can be selected for structural purposes for secure and stable connection of the screen panel to the subframe. The characteristics advantageously can be quite separate and can be selected to maximise the performance of the separate components. Because of this, the downtime of the vibratory machinery can be minimized thus improving mine output.

Moreover, by the screen extending over the upper edge of the frame to overlie each of the outwardly facing surfaces of the side and end members of the frame, abutting engagement between adjacent screening panels on a screening deck can be made by contact between the respective screens of the screening panels, rather than having abutting engagement between adjacent frames. Except for those screen panels that are located at the edge of the screen deck of the vibratory machine, the screen panels will abut on all four edges (being the sides and ends) with adjacent screen panels, with the abutment being between the screens of the screen panels rather than the frames of the screen panels. This will potentially provide greater security against ingress of screening material between adjacent screening panels, by virtue of the engagement between the relatively soft material of the screens rather than the usually harder material of the frames.

The skirt of the screen of the screen panel can be defined by a pair of spaced apart and parallel side skirt members and a pair of spaced apart and parallel end skirt members, which form a generally square or rectangular skirt shape. In this form of skirt, the outwardly facing surface of the frame can have a channel formed in each of the side and end frame members and the side and end skirt members of the skirt can include an inwardly extending projection for receipt within the channels of the side and end frame members. In this arrangement, the skirt is connected to the outwardly facing surface of the frame upon receipt of the projections within the channels.

The above arrangement can also be reversed, whereby projections can be formed on the side and end frame members and the skirt can include the channels for receipt of the projections. Alternatively, there can be a mix of projections and channels so that, for example, the side skirt members can have projections and the end skirt members can include channels, with respective channels and projections formed in the side and end frame members.

However, in the first form of the invention referred to above whereby the skirt includes projections and the frame includes channels, the channels formed in the side frame members can be of a greater depth than the channels formed in the end frame members, whereby depth is measured between upper and lower edges of the frame members. The provision of greater depth in the channels formed in the side frame members allows those channels to accept not only the projections of the side skirt members, but also connectors for connecting the frame of the screen panel to the subframe of a vibratory machine. For example, the arrangement disclosed in applicant's Australian Patent No. 2012201297 shows elongate fixing rails which connect to adjacent beams of a vibratory machine and side members of screen panels. In the present invention, the projections of the side skirt members can be received within the channels of the side frame members closer to the upper edge of the frame and the connection between the connectors, which can be the fixing rails as disclosed in Patent No. 2012201297, and the side members of the frame can be within the channels of the side frame members but below the projections of the side skirt members, ie further away from the upper edge of the frame.

The channels formed in the end frame members can have a base and a bearing surface extending from the base for bearing engagement with the projection of the end skirt members. The channels can be formed in a U or C shape, whereby the base and bearing surface are disposed substantially perpendicular to each other and the bearing surface is substantially planar and perpendicular to the general plane of the end frame members. In other words, with the screen panel fixed to the subframe of a vibratory machine, the bearing surface extends generally horizontally and parallel to the screen surface formed by the deck of screen panels, and the base extends generally vertically, so that the bearing surface and base are disposed generally perpendicular to each other. For proper engagement with the bearing surface, the projection of the end skirt members can also be planar or partially planar so that a substantially flat bearing engagement is made between the projection and the bearing surface. This arrangement can also be adopted between the projections of the side skirt members and the channels of the side frame members.

The bearing engagement made between the projection and the bearing surface is intended to be constant so that the screen of the screen panel is securely fixed to the frame and so that while there might be some oscillation of the screen surface during operation of the vibratory machinery, the edges of the screen do not lift away from the edges of the frame.

While the channels formed in the side frame members can have a depth to accept both the projections of the side skirt members as well as connectors for connecting the frame to the subframe of a vibratory machine, the channels of the end frame members can be sized to closely receive the projections of the end skirt members. Thus, the channels of the end frame members can be of a similar size to the projections of the end skirt members so that the channels are substantially filled with the projections upon their insertion into the channels.

In the case of substantially flat bearing engagement between the respective projections and bearing surfaces of the skirt and the frame, the generally flat engagement precludes vertical lifting away of the skirt from the frame. If desired, the flat surface can have a slight angle or chamfer to facilitate insertion and removal of the projections from the channels, although with embodiments of the invention that will be described later herein, that type of arrangement is not necessarily required.

While the skirt of the screen can be a continuous skirt, in some forms of the invention it includes a discontinuity to create at least one gap in the skirt. A gap is intended to increase the ease with which the screen can be attached to and removed from the frame as it can increase the flexibility of the frame, but of course the size of the gap and its position will influence the level of ease for this connection between the screen and the frame and the level of ease for disconnection of the screen from the frame.

In some forms of the invention, a pair of gaps can be provided which are formed at diametrically opposed corners of the skirt. In other forms of the invention, four gaps are formed at each corner of the skirt.

In still other forms of the invention, a gap is provided in one or more of the end and side members of the skirt between the corners. For example, a gap can be provided midway between the corners in one or more of the end and side skirt members.

Where four gaps are formed in each of the corners of the skirt, these can be formed by opposite ends of the side skirt members extending close to but being spaced from adjacent opposite ends of the end skirt members. The reverse arrangement can also be adopted.

Where the skirt includes side and end skirt members with projections formed on each of those members, the projections of the end skirt members can extend across those members from a position inboard of each end of those members. That is, the projections do not extend to the very end of each of the end skirt members, but rather, commence from a position slightly inboard from the ends. This allows the channels of the end frame members to be terminated inboard of the ends of those frame members but to have the end skirt members extend just beyond the opposite ends of the channels. Thus, there is an overlap of the skirt over the ends of the channels so that ingress of screened material into the channels is resisted and the overlap can be where a screen removal tool is inserted to remove a screen from connection with a frame.

The projections of the side skirt members can extend fully across the side skirt members from each of the ends of those members. In this construction, the frame can be recessed at the side frame members, so that the side skirt members are received within a recess and the channel is formed in that recess completely across the side frame members. The side skirt members can be a close fit within the recess and extend from opposite ends of the recess, for example in engagement with the opposite ends of the recess, again, to resist entry of screened material into the recess and the channel.

Again, the reverse of the arrangement described above can be adopted so that the projections of the side skirt members can extend across those members from a position inboard of each end of those members and the projections of the end skirt members can extend fully across the end skirt members from each of the ends of those members, with the construction of the side and end frame members being adjusted accordingly.

The screen panel of the invention can include inner walls or flanges which are positioned inboard of the skirt and that are in spaced apart and facing relationship with the skirt to define a channel for receipt of one or more portions of the frame. For example, the inner walls can form a generally square or rectangular shape inboard of the skirt to closely accept the square or rectangular frame. Where a centre member is provided in the frame that extends or bridges across the frame between opposite end or side walls, the inner walls can also form a channel for receipt of the centre member. In the above arrangement in which a centre member is provided, the inner walls can form a pair of adjacent or side by side square or rectangular walls which form a channel between them for receipt of the centre member.

The formation of the inner walls or flanges described above can provide several advantages. One major advantage is that the close fit of the frame within the channel between the skirt and the walls more securely connects the screen to the frame. This arises because capturing the frame in a channel reduces the available flex of the screen at the edges of the screen where the screen connects to the frame and reduced flex at the edges means that the screen is less likely to pull away from the connection with the frame. However, flexibility of the screen inboard of the edges is not affected and so the benefits of a flexible screen are maintained despite the more secure connection between the screen and the frame.

Also, capturing the frame in a channel reduces the likelihood of fines or coarse ore becoming trapped between the frame and the facing surface of the screen. Where this does happen (such as in prior art arrangements), the vibratory motion of the screen panel causes the fines or coarse ore to rub against the frame and the screen, causing wear. Thus, if the screen surface moves away from the facing frame surface during downward movement of the screen panel under vibration, fines or coarse ore can enter the space between the screen and the frame and become trapped as the screen moves upward and the screen and the frame come together. The fines or coarse ore can actually be compressed between the screen and the frame and thus more firmly attached to the screen or the frame in that position. Because of the abrasive nature of fines or coarse ore, any relative movement between the screen or the frame causes an abrasive rubbing action and either or both of the screen or the frame can be worn prematurely. That wear can cause the screen or the frame to fracture and to require premature replacement. Accordingly, an arrangement to prevent or at least minimise the ingress of fines or coarse ore to a position between the screen and frame is advantageous and is achieved by the use of the skirt and wall arrangement discussed above.

The arrangement of the invention discussed above is further advantageous in that the channel arrangement can be configured so that the flexibility of screen surface is maintained despite that the centre member (where provided) is captured within a channel. That configuration can be that the centre member is captured within a channel in a manner that the channel can shift relative to the centre member as the screen oscillates relative to the frame. Thus the channel can move upwardly and downwardly relative to the centre member as the screen oscillates but the centre member remains captured within the channel and fines or coarse ore are precluded or at least obstructed from entry into the channel. The side walls of the channel are thus configured to be a close and touching fit against the sides of the centre member, but that fit does not stop relative movement between the screen and the centre member.

For a better understanding of the invention and to show how it may be performed, embodiments thereof will now be described, by way of non-limiting example only, with reference to the accompanying drawings.

BRIEF DESCRIPTION OF DRAWINGS

In order that the invention may be more fully understood, some embodiments will now be described with reference to the figures in which.

DETAILED DESCRIPTION

Figure 1:
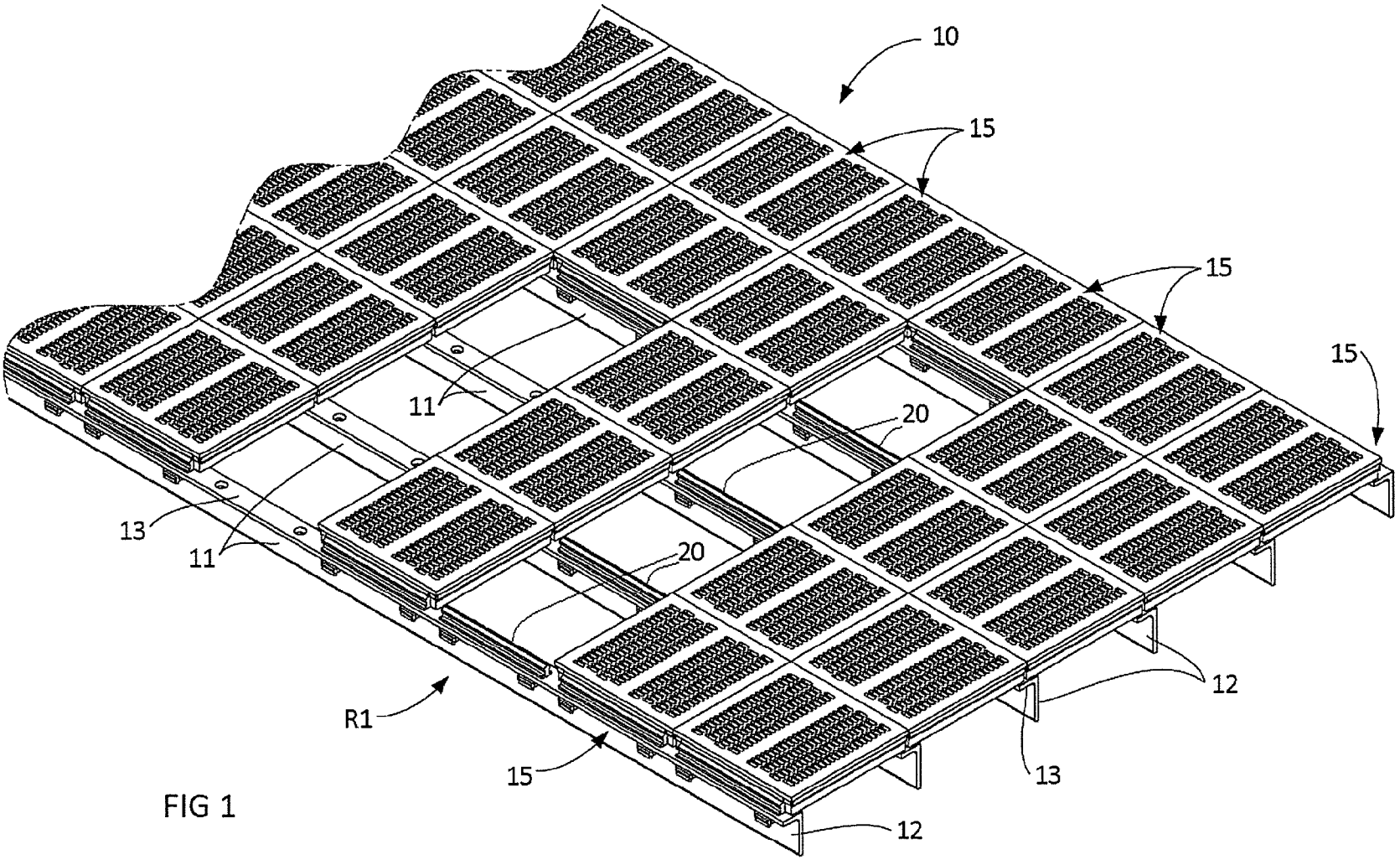
FIG. 1 illustrates a portion of a screening deck according to one embodiment of the invention.

With reference to FIG. 1, a portion of a screening deck and subframe 10 of a vibratory machine is illustrated, comprising a plurality of elongate, longitudinal beams 11 each of which is formed from an angle of steel having a vertical portion 12 and a horizontal portion 13 disposed substantially at right angles. While the beams 11 extend in the longitudinal direction of the vibratory machine, the beams can equally extend perpendicularly to the longitudinal direction of the vibratory machine and the invention applies to that form of vibratory machine as well. The beams 11 can be of any length, such as increasing from 4' to 28' in 2' increments. The width dimensions likewise can be of any length, such as increasing from 2' to 14' in 2' increments.

The deck and subframe 10 illustrated in FIG. 1 is a portion of a vibratory machine only and does not show the side edge beams that define the edge of the screening deck. The portion of the deck and subframe that is shown in FIG. 1 is sufficient however to describe the invention. Six beams 11 are illustrated in FIG. 1. In current machinery, the beams 11 are often spaced an imperial foot apart thus requiring nine beams for an 8' width.

The beams 11 extend parallel to one another and support screen panels 15 on the upper face of the short portion 13 of each beam 11. The panels illustrated in FIG. 1 can be of any suitable size, but a common size is an imperial square foot (304.8 mm×304.8 mm). However, alternative sizes of panels can be employed, such as 1'×2' (or 304.8 mm×609.6 mm).

As indicated above, the screening deck and subframe is one part of the overall vibratory machinery. The screening deck is supported on a frame and is connected to a vibration generator. The vibration that is generated is significant and requires the panels 15 to be securely fixed to the beams 11. The panels are also subject to wear over time and even though the fixing of the panels to the beams is required to be secure, the preference is also that the panels be easily releasable to facilitate quick and easy replacement.

Figure 3:
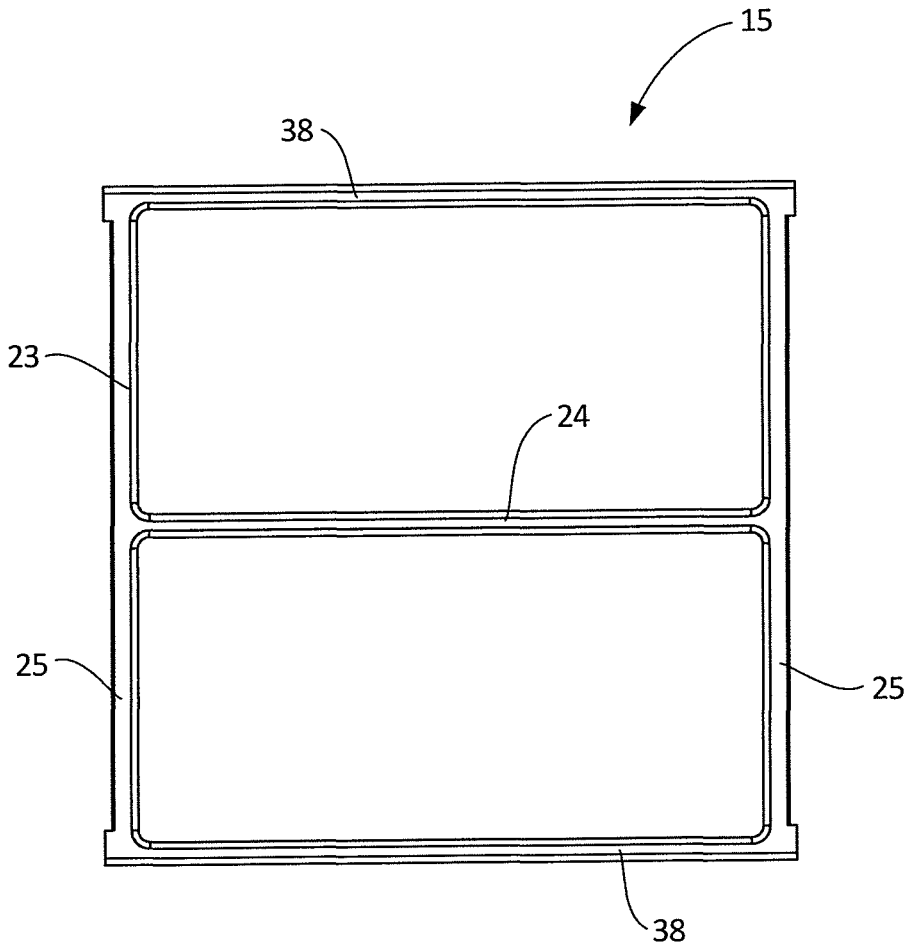
FIG. 3 is a plan view of a frame of a screening panel according to one embodiment of the invention.

The panels 15 include a plurality of openings through the top or screening surface thereof for screening product such as mining ore. The openings in the panel 15 can vary from large to very small depending on the size of the screened material which is to be produced. Indeed in some forms of the invention, the panel is completely open rather than having a plurality of openings. That is, the top of the panels 15 are formed to be fully open, with the exception that in some forms, the frame of the panel will include a stiffening bar extending across the panel (referred to herein as a centre member, usually midway between opposite ends or sides of the panel (this is seen in FIG. 3).

Typically, an ore is fed onto one end of the screening deck 10 and a vibrating arrangement vibrates the deck 10 tending to shift the ore from one end to the other, with some of the ore passing through the openings of the panels 15 as it travels over the deck. Ore which does not pass through openings in the panels 15 is collected or transferred at the trailing end of the deck 10 opposite to the feeding end and can be retreated, such as re-crushed, or it can be used for other purposes or discarded.

FIG. 1 shows several portions on the screening deck 10 that do not have panels installed. These vacant portions illustrate that the panels 15 can be removed when they have become worn or otherwise damaged. The portion of the screening deck 10 marked R1 shows four missing panels, but otherwise illustrates fixing rails 20 to which panels 15 are attached. The fixing rails 20 are fixed to the upper surface of the horizontal portion 13 of the beams 11 and more detail on the construction of the fixing rails 20 and their connection to the beams 11 can be found in Applicant's Australian Patent No. 2012201297.

The screening deck 10 includes panels 15 shown in close proximity to each other. The preference is that the panels 15 actually make contact along their edges so that there are no gaps between the panels when they are fitted. Any gaps between adjacent panels 15 can provide an undesirable pathway for the flow of material being screened. In some prior art arrangements, a cover strip has been applied between adjacent panels to overlie the junction at the upper surface of adjacent panels to cover any gaps between them.

Figure 2:
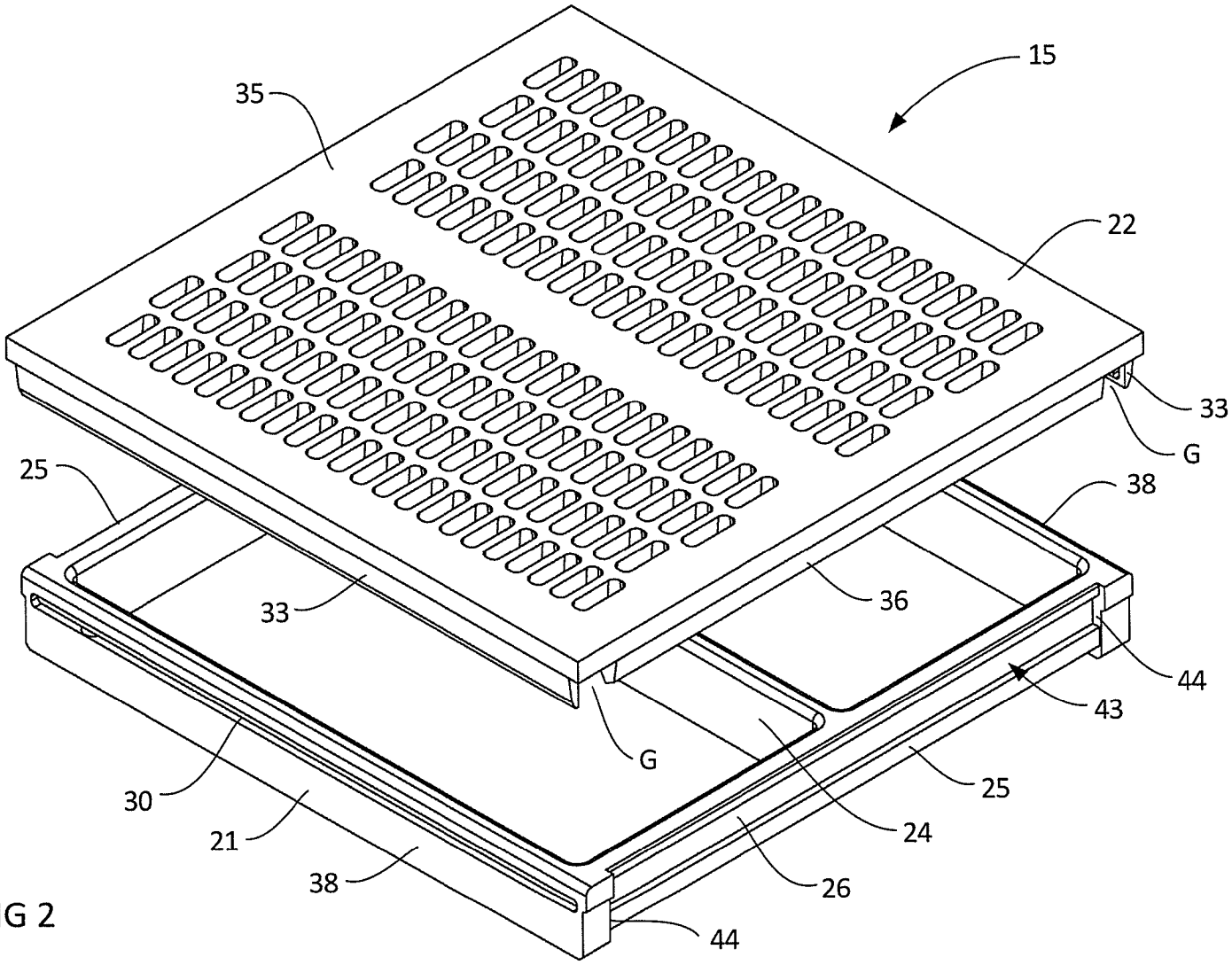
FIG. 2 is an exploded view of a screen panel according to one embodiment of the invention.

Applicant's Australian Patent No. 2012201297 provides adjustment for the panels 15 as they are fitted to the screen deck in order to achieve a close fit between the panels The panels 15 of the screening deck 10 have a particular construction that is unique in relation to prior art panels. FIG. 2 is an exploded view of a screen panel 15 of the kind illustrated in FIG. 1. The screen panel 15 includes a frame 21 and a screen 22. The screen 22 includes a plurality of screening openings through a screening surface for screening mining ores and the like. The invention is not limited to any particular size of opening and in fact, the screen could be completely open to maximise the size of the material that can fall through the screening deck 10.

The frame 21 is shown in plan view in FIG. 3 and shows the frame 21 as having a square external periphery 23 (which measures an imperial square foot or approximately 929 $cm^2$) and a centre member 24 that extends between opposite side members 25 of the periphery 23. The centre member 24 adds stiffness to the screen panel 15. The section of the screen 22 that overlies the centre member 24 has no openings as the centre member 24 would interfere with the passage of screened media through them if they were provided.

Figure 4:
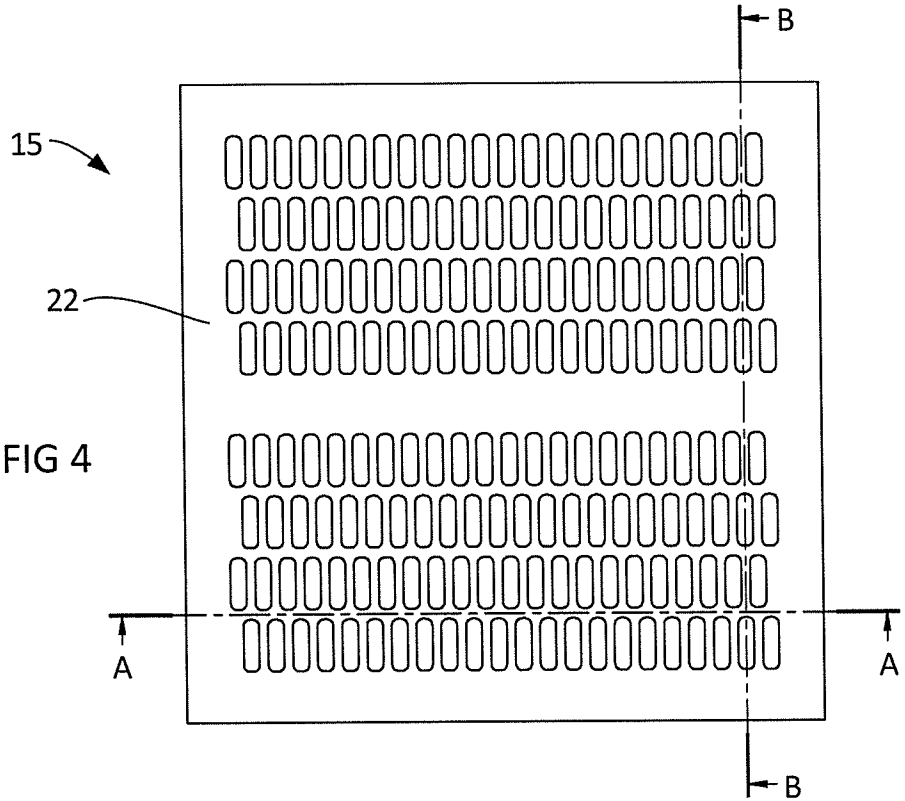
FIG. 4 is a plan view of the screen of a screen panel according to one embodiment of the invention.

The frame 21 and the screen 22 have a construction that allows interconnection between them. Some of that interconnecting construction can be seen in FIGS. 2 and 3, but a better illustration is made in FIGS. 4 to 6 which shows the frame 21 and the screen 22 connected together in plan and cross-sectional views.

Figure 5:
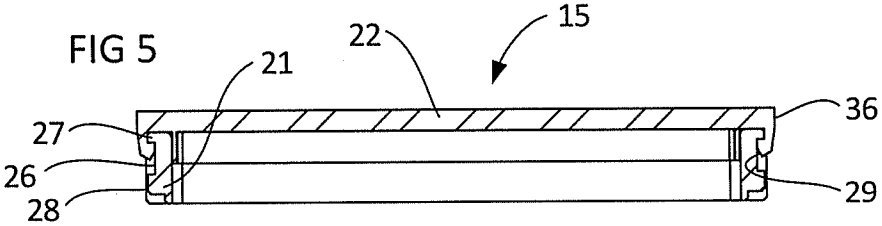
FIG. 5 is a cross-sectional view through A-A of FIG. 4.

With reference to FIG. 5, the frame 21 includes an outwardly opening elongate recess or channel 26 defined between upper and lower flanges 27 and 28. The screen 22 includes a skirt 36 that extends over the upper flange 27 and to overlie the channel 26. The skirt 36 includes an inwardly depending projection 29 that extends into the channel 26.

Figure 6:
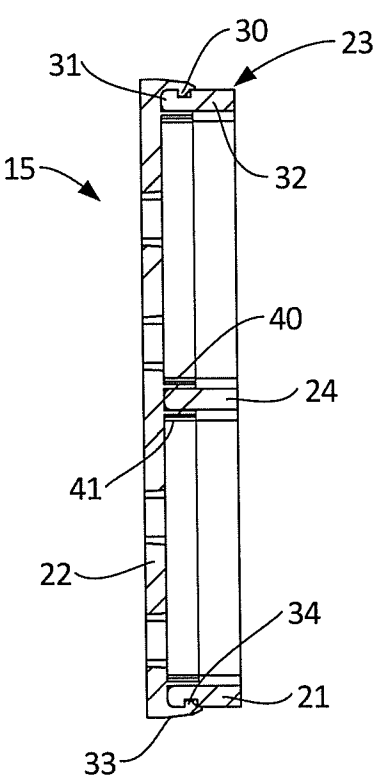
FIG. 6 is a cross-sectional view through B-B of FIG. 4.

A similar arrangement is repeated through the cross-section of FIG. 6 in which the frame 21 includes an outwardly opening elongate recess or channel 30 defined between upper and lower flanges 31 and 32. The screen 22 includes a skirt 33 that extends over the upper flange 31 and to overlie the channel 30. The skirt 33 includes an inwardly depending projection 34 that extends into the channel 30.

Figure 7:
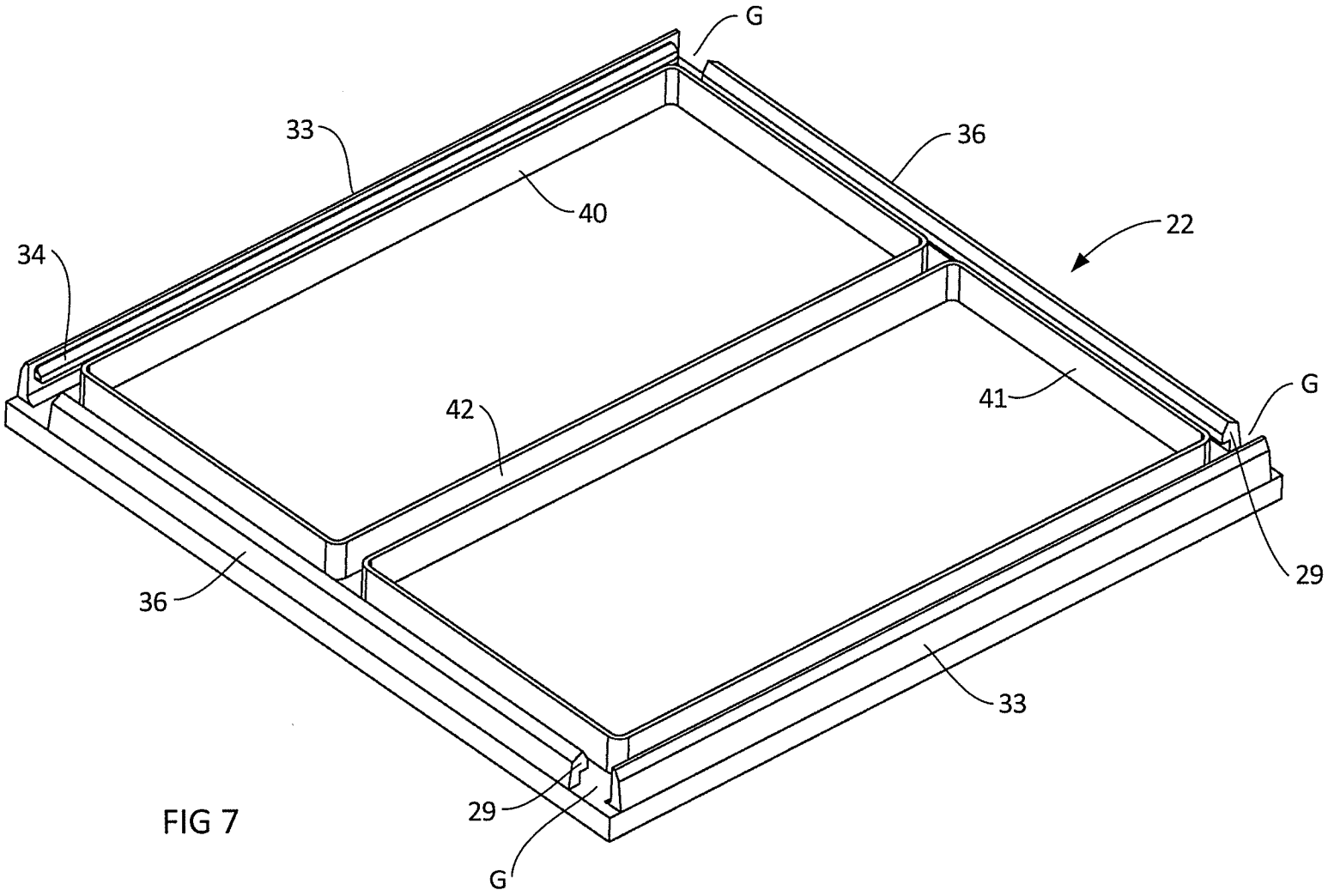
FIG. 7 is an underneath isomeric view of the screen of a screen panel according to one embodiment of the invention.

Returning to FIG. 2, the respective skirts 33 and 36 can be seen depending from the top surface 35 of the screen 22. Each skirt 33 and 36 can connect with the frame 21 as described above. The respective skirts 33 and 36 represent front and rear skirts (33) and side skirts (36) as the screen 22 is oriented on the screening deck 10 of FIG. 1. The front and rear skirts 33 extend almost fully across the screen 22, while the side skirts 36 extend to a position which is spaced slightly from connection with the skirts 33. This is also seen in FIG. 7 which is an underneath view of the screen 22. In that figure, it can be seen that inner walls 40 and 41 form adjacent or side by side rectangular walls which are spaced inwardly from the skirts 33 and 36 to define channels for receipt of the periphery 23 of the frame 21 and to further define a channel 42 to accept the centre member 24 of the frame. See FIG. 6 which shows the periphery 23 of the frame 21 and the centre member 24 captured within the channels formed between the walls 40 and 41. The fit between the screen 22 and the frame 21 is to be a snug or light fit, not a friction fit. As described earlier, oscillation of the surface of the screen 22 is desirable and a close but not tight fit between the channel 42 and the centre member 24 allows this. The screen 22 is held to the frame 21 by cooperation between the projections 29 and 34 within the channels 26 and 30 rather than by friction engagement between the channels into which the frame 21 is fitted.

The channels into which the frame 21 is received advantageously provide several advantages already discussed above. One major advantage is that the close fit of the frame 21 within the channel between the skirts 33 and 36 and the walls 40 and 41 more securely connect the screen 22 to the frame 21. This arises because capturing the frame 21 in a channel reduces the available flex of the screen 22 at the edges of the screen 22 and reduced flex at the edges means that the screen is less likely to disconnect from the frame 21. However, oscillation of the screen inboard of the edges is not affected.

Also, capturing the frame in a channel reduces the likelihood of fines or coarse ore becoming trapped between the frame and the facing surface of the screen as described earlier. The channels thus effectively act as shedders to shed fines or coarse ore away from the frame 21.

The gap G (see FIG. 2) is an important aspect of the screen panel 15, as it facilitates easier connection and disconnection of the screen 22 from the frame 21. The gap G allows each of the skirts 33 and 36 to flex outwardly to allow the respective projections 29 and 34 to ride over the upper flanges 27 and 31 of the frame 21 and to thereafter enter the respective channels 26 and 30 and thus to fix the screen 22 to the frame 21.

The gap G also allows a tool to be inserted beneath one of the skirts 33 and 36 to lift them away from the frame to remove the screen 22 from the frame 21.

Despite that the gap G provides advantages as discussed above, the invention extends to screens that do not have a gap, or that have a gap at a different position. Screens that do not have a gap could fit more tightly on the frame 21, but be more difficult to fit and remove. Screens that have a gap at a different position than at the corners of the screen 22 could have a gap inboard of the ends of one or more of the skirts 33 and 36, such as towards the middle of the skirts. Only one of the skirts, or one pair of skirts might include a gap. For example, two gaps might be provided at diametrically opposed corners of the screen and no gaps at the other corners.

Moreover, FIG. 2 illustrates that the channel 30 into which the projection 34 (see FIG. 6) of the skirt 33 enters does not extend fully across the end wall 38. Rather, the channel 30 terminates just prior to each end of the end wall 38. This provides tooling advantages for post moulding part dress up.

Figure 8:
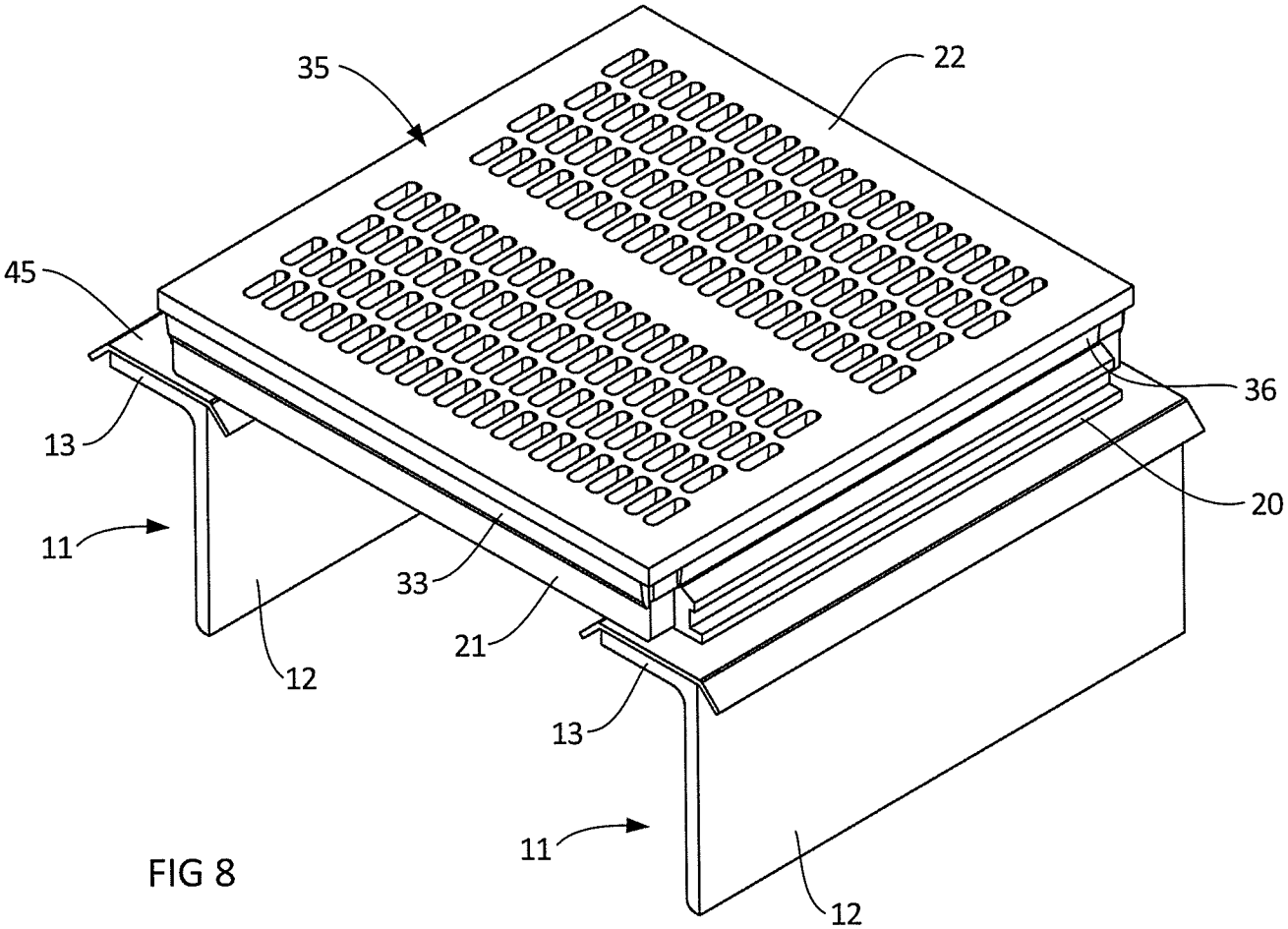
FIG. 8 is a top isometric view of a screen panel according to one embodiment of the present invention, connected to a screen deck.

In a similar manner, the channels 26 also terminate within the length of the side walls 25, but this is to ensure proper connection with the fixing rails 20 to fix the screen panels to the screening deck. As seen in FIG. 8, the fixing rails 20 engage within the channels 26 below the bottom of the skirt 36 of the screen 22 and the ends of the fixing rails 20 abut against the facing surfaces of the respective channels 26 to form a close fit within the channels 26. The space for receipt of the fixing rails 20 below the bottom of the skirt 36 can be seen in FIG. 5. This arrangement is more fully illustrated in Applicant's Patent No. 2012201297.

It can also be seen in FIG. 2 that the channel 26 is formed in a recessed portion 43 between end walls 44. The skirt 36 is received closely within the recess 43.

FIG. 8 also illustrates the use of shedders 45 between the horizontal portions 13 of the beams 11 of the screening deck 10 and the underneath of the screen panel 15 and the fixing rails 20 to prevent or minimise the ingress of screened media between the screen panel 15 and the fixing rails 20 and the horizontal portions 13 of the beams 11.

The illustrated embodiments have been described in relation to a screening deck 10 that includes beams 11 of 90° angle, however it is to be noted that the invention can equally apply to screening decks of other construction, such as that disclosed in Applicant's Patent No. 2012211453 and as particularly shown in FIG. 2 of that application. Such a construction is known in the industry as a "pipe-top" construction.

The illustrated embodiment also shows that each of the skirts 33 and 36 include a respective projection 29, 34 for entry into a respective channel 26, 30 of the frame 21. It must be appreciated that the invention extends to arrangements in which the projections extend from the frame and the skirts of the screen include the channels into which the projections extend.

Throughout the description and claims of this specification the word "comprise" and variations of that word, such as "comprises" and "comprising", are not intended to exclude other additives, components, integers or steps.

The claims defining the invention are as follows:

1. A screen panel for mounting to a vibratory screening apparatus for the purpose of screening, separating or grading materials, the screening apparatus including a plurality of spaced apart, substantially parallel elongate beams to which the screen panel is to be mounted, the screen panel comprising:

i. a square or rectangular frame which includes a pair of spaced apart and parallel side frame members and a pair of spaced apart and parallel end frame members connected to the side members, the frame defining a square or rectangular upper edge and the side and end frame members defining a square or rectangular outwardly facing surface, the frame being connectable to a pair of adjacent elongate beams of a vibratory screening apparatus by connectors that connect with the outwardly facing surface of the side frame members, ii. a square or rectangular screen which is connected to the frame, the screen extending over the upper edge of the frame and forming a square or rectangular skirt which overlies the outwardly facing surface of the frame and which connects to each of the side and end frame members along the outwardly facing surface to connect the screen to the frame, iii. the connection between skirt of the screen and the outwardly facing surface of the side frame members of the frame being made closer to the upper edge of the frame than where the connection between the connectors and the outwardly facing surface of the side members of the frame is made.

2. A screen panel according to claim 1, the skirt being defined by a pair of spaced apart and parallel side skirt members and a pair of spaced apart and parallel end skirt members, the outwardly facing surface of the frame having a channel formed in each of the side and end frame members and the side and end skirt members including an inwardly extending projection for receipt within the channels of the side and end frame members.

3. A screen panel according to claim 2, the channels formed in the side frame members being of a greater depth than the channels formed in the end frame members, whereby the channels formed in the side frame members accept the inwardly extending projections of the side skirt members as well as connectors for connecting the frame to the adjacent elongate beams of the screening apparatus.

4. A screen panel according to claim 3, the channels formed in the end frame members having a base and a bearing surface extending from the base for bearing engagement with the projection of the end skirt members, the base and the bearing surface being disposed substantially perpendicular to each other and the bearing surface being substantially planar and perpendicular to the general plane of the end frame members.

5. A screen panel according to claim 4, the projections of the end skirt members including a planer bearing surface for engagement with the planar bearing surface of the channels of the end frame members.

6. A screen panel according to claim 3, the channels of the end frame members being sized to closely receive the projections of the end skirt members.

7. A screen panel according to claim 1, wherein the skirt includes at least one discontinuity to create at least one gap in the skirt.

8. A screen panel according to claim 7, wherein a pair of gaps is formed at diametrically opposed corners of the square or rectangular skirt.

9. A screen panel according to claim 7, wherein four gaps are formed at each corner of the square or rectangular skirt.

10. A screen panel according to claim 9, wherein the four gaps are formed by opposite ends of the side skirt members extending close to but being spaced from adjacent opposite ends of the end skirt members.

11. A screen panel according to claim 2, the projections of the end skirt members extending across the end skirt members from inboard of each end of the end skirt members.

12. A screen panel according to claim 2, the projections of the side skirt members extending across the side skirt members from each of the ends of the side skirt members.

13. A screen panel according to claim 1, the frame including a centre member that extends across the frame between opposite end or side walls and the screen including a channel within which the centre member is disposed, the walls of the channel being a close fit against the side walls of centre member but the channel being movable relative to the centre member upon vibration of the screen panel.

14. A screen panel according to claim 1, the screen including inner walls inboard of the skirt that are in spaced apart facing relationship with the skirt to define a channel for receipt of side frame members and the end frame members of the frame.

15. A screen panel according to claim 14, the inner walls forming a generally square or rectangular shape inboard of the skirt.

16. A screen panel according to claim 14, the inner walls forming a pair of adjacent square or rectangular walls which form a channel between them for receipt of the centre member.

* * * * *